US007218063B2

(12) United States Patent
Konopka et al.

(10) Patent No.: US 7,218,063 B2
(45) Date of Patent: May 15, 2007

(54) TWO LIGHT LEVEL BALLAST

(75) Inventors: John G. Konopka, Deer Park, IL (US); Naveen Yadlapalli, Hoffman Estates, IL (US); Shashank Bakre, Schaumburg, IL (US); Himamshu Prasad, Round Lake, IL (US)

(73) Assignee: Osram Sylvania, Inc., Danvers, MA (US)

( * ) Notice: Subject to any disclaimer, the term of this patent is extended or adjusted under 35 U.S.C. 154(b) by 239 days.

(21) Appl. No.: 11/139,068

(22) Filed: May 27, 2005

(65) Prior Publication Data

US 2006/0267516 A1 Nov. 30, 2006

(51) Int. Cl.
*G05F 1/00* (2006.01)

(52) U.S. Cl. ..... 315/291; 315/307; 315/279; 315/276; 315/274

(58) Field of Classification Search ..... 315/291, 315/307, 224, 309, 308, 297, 274, 276, 279, 315/282, 287
See application file for complete search history.

(56) References Cited

U.S. PATENT DOCUMENTS

| | | | | |
|---|---|---|---|---|
| 4,052,751 | A * | 10/1977 | Shepard | 361/50 |
| 5,177,409 | A | 1/1993 | Nilssen | 315/293 |
| 5,194,781 | A | 3/1993 | Konopka | 315/291 |
| 5,373,218 | A | 12/1994 | Konopka et al. | 315/291 |
| 5,475,285 | A | 12/1995 | Konopka | 315/224 |
| 5,831,395 | A | 11/1998 | Mortimer et al. | 315/307 |

* cited by examiner

*Primary Examiner*—Tuyet Thi Vo
(74) *Attorney, Agent, or Firm*—Kenneth D. Labudda; Fitch, Even, Tabin & Flannery

(57) ABSTRACT

A ballast (100) for powering at least one gas discharge lamp (30) at two selectable light levels includes a sensing transformer (120) and a detector circuit (200). Detector circuit (200) provides an output voltage that is dependent on the states of two on-off switches (S1,S2) interposed between the ballast (100) and a conventional AC source (20). The output voltage of the detector circuit (200) is used to control the illumination level of the lamp (30).

15 Claims, 3 Drawing Sheets

TWO LIGHT LEVEL BALLAST

FIELD OF THE INVENTION

The present invention relates to the general subject of circuits for powering discharge lamps. More particularly, the present invention relates to a ballast that selectively powers a discharge lamp at two illumination levels.

STATEMENT OF RELATED APPLICATIONS

The subject matter of the present application is related to that of U.S. patent application Ser. No. 11/010,845 (titled "Two Light Level Ballast," filed on Dec. 13, 2004, and having the same inventors and the same assignee as the present invention), the disclosure of which is incorporated herein by reference.

BACKGROUND OF THE INVENTION

Two light level lighting systems have been utilized in overhead lighting for many years. Typically, two light level systems are implemented by using two power switches and two ballasts in each lighting fixture, wherein each of the power switches controls only one of the ballasts in the fixture. Turning on both of the switches at the same time powers both ballasts, thus producing full light output from the fixture. Turning on only one of the switches applies power to only one of the ballasts in the lighting fixture and results in a reduced light level and a corresponding reduction in power consumed.

Because it is more economical to have a single ballast in the fixture instead of two, a system for producing the same result using only a single ballast is desirable. For compatibility purposes, the ballast would be required to operate from the same two power switches used in the two ballast system. When both switches are closed, the ballast would operate in a full light mode. Conversely, when only one of the two power switches is closed, the ballast would operate in a reduced light mode.

Two light level systems that require only a single ballast are known in the art. For example, U.S. Pat. No. 5,831,395 (issued to Mortimer) discloses one such system, which is described in FIG. 1. As shown in FIG. 1, the Mortimer system includes a detector circuit 270 that provides a control signal that is dependent on the states of two on-off switches S1 and S2. Theoretically, when only one of the switches S1,S2 is on, the control signal will be at a first level, causing the ballast to drive the lamp at a reduced light level; when both of the switches S1,S2 are on, the control signal will be at a second level, causing the ballast to drive the lamp at a higher light level.

Unfortunately, the Mortimer system has a major limitation in that detector circuit 270 may not function properly in the presence of X capacitances that are typically present between the hot and neutral wires that connect the ballast to the switches S1,S2 and the AC source. These X capacitances (denoted by dashed line/phantom capacitor symbols in FIG. 1) are present due to EMI circuitry in the ballast and/or the nature and length of the wiring between the AC source, switches S1,S2, and the ballast. Essentially, these X capacitances compromise the ability of detector circuit 270 to distinguish between a condition where only one switch is closed versus a condition where both switches are closed, and thus defeat the intended functionality of a two light level approach. This problem is particularly pronounced when multiple ballasts are connected to the same branch circuit, in which case the X capacitances due to the EMI circuitry in each ballast, and/or the wiring between the AC source, switches S1,S2, and each ballast, are additive.

What is needed, therefore, is a ballast that provides two light levels but that is substantially insensitive to the capacitances that are typically present in actual lighting installations. One such ballast is disclosed in U.S. patent application Ser. No. 11/010,845 (titled "Two Light Level Ballast," filed on Dec. 13, 2004, and having the same inventors and the same assignee as the present invention). The present application discloses yet another two light level ballast that avoids the aforementioned disadvantages of the prior art

DETAILED DESCRIPTION OF THE PREFERRED EMBODIMENTS

Figure 1:
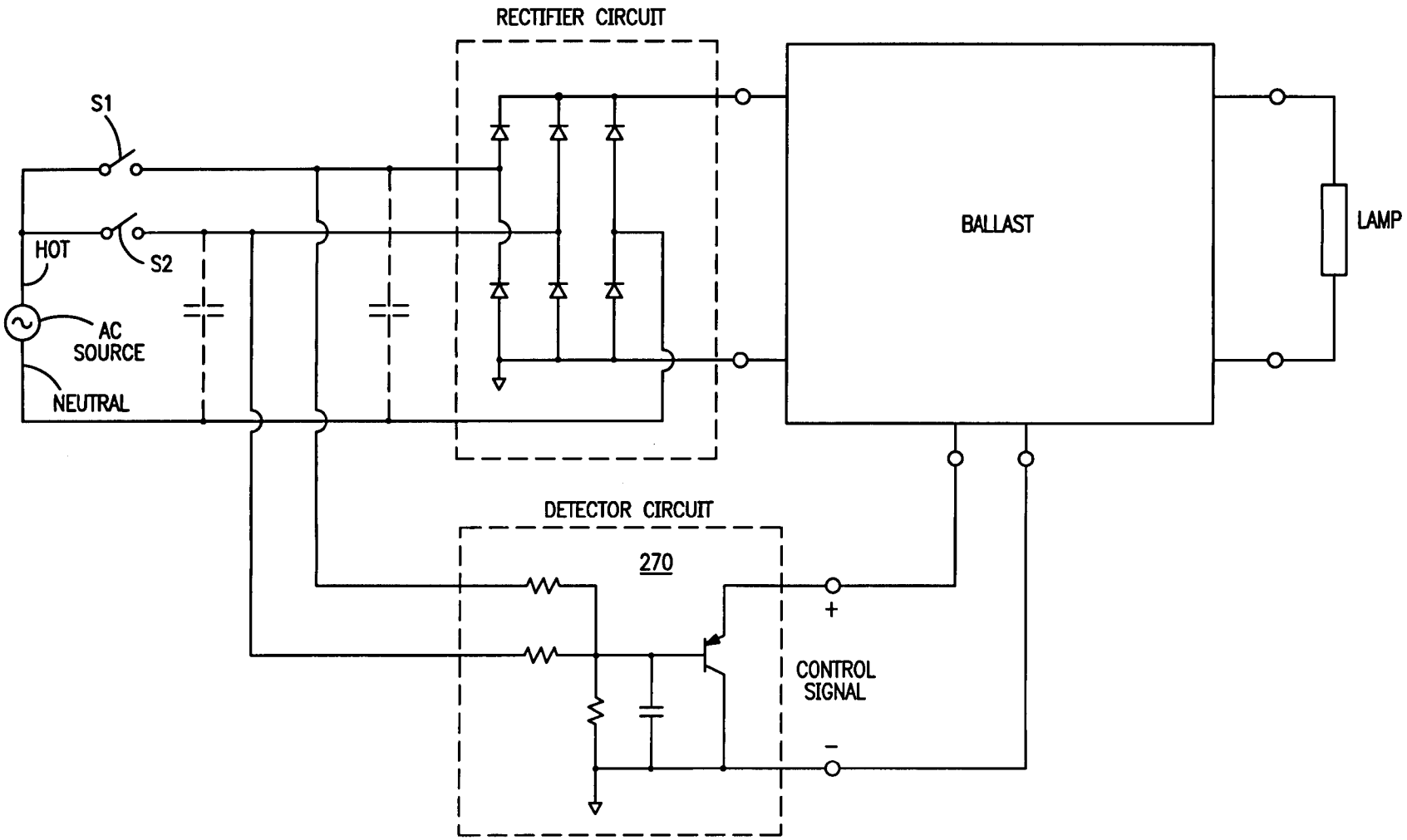
FIG. 1 PRIOR ART
FIG. 1 is a schematic diagram of a two light level ballast, in accordance with the prior art.
Figure 2:
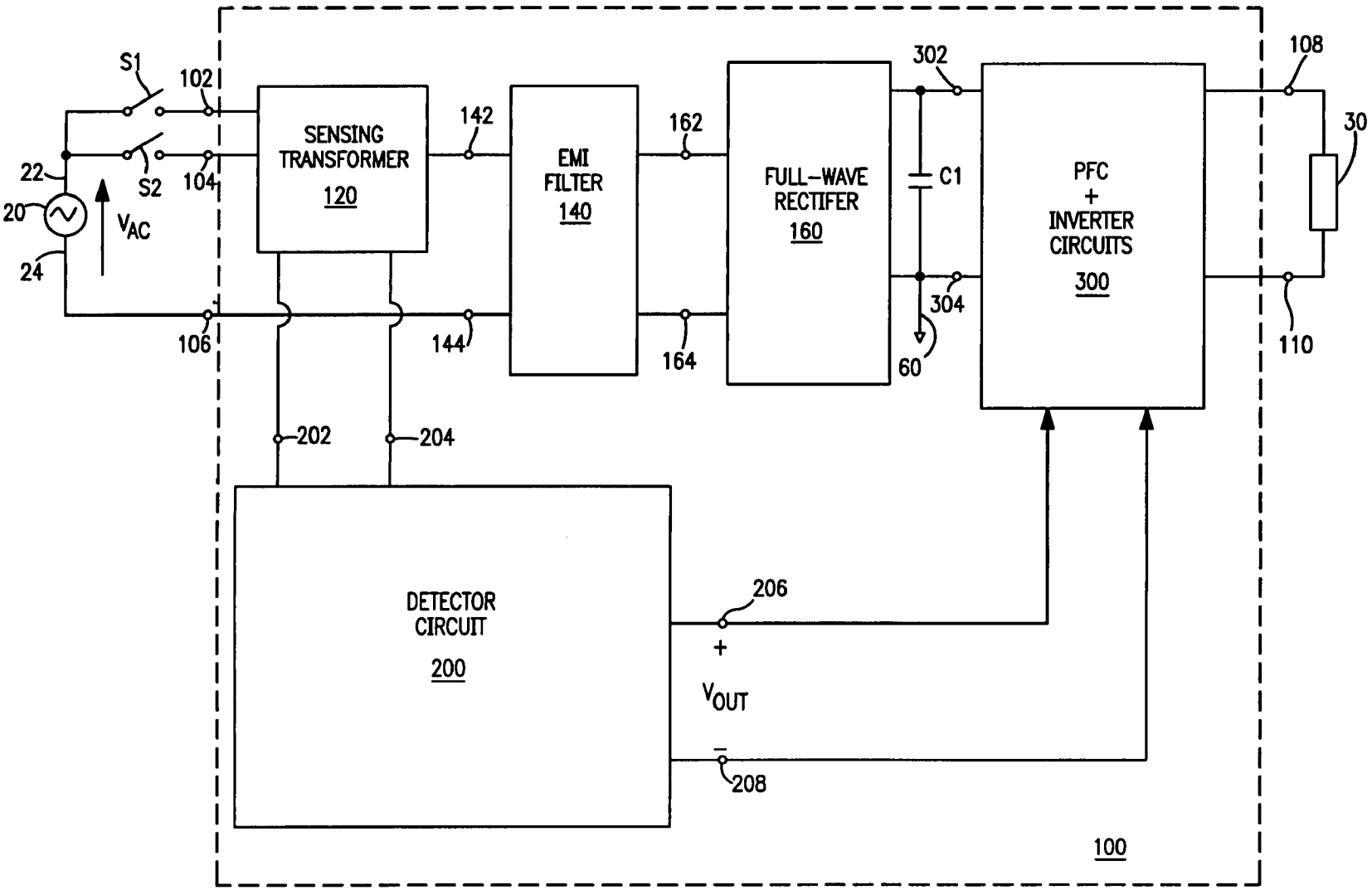
FIG. 2 is a block diagram schematic of a two light level ballast, in accordance with a preferred embodiment of the present invention.

FIG. 2 describes a ballast 100 for powering at least one gas discharge lamp 30 from a conventional alternating current (AC) voltage source 20. Ballast 100 comprises a plurality of input connections 102,104,106, a sensing transformer 120, an electromagnetic interference (EMI) filter 140, a full-wave rectifier circuit 160, a capacitor C1, a detector circuit 200, power factor correction (PFC) and inverter circuits 300, and output connections 108,110.

The plurality of input connections includes a first hot input connection 102, a second hot input connection 104, and a neutral input connection 106. First hot input connection 102 is adapted for coupling to a hot wire 22 of AC source 20 via a first on-off switch S1. Second hot input connection 104 is adapted for coupling to the hot wire 22 of AC source 20 via a second on-off switch S2. Switches S1 and S2 are typically implemented by conventional wall switches having an on state and an off state. Neutral input connection 106 is adapted for coupling to a neutral wire 24 of AC source 20. Output connections 108,110 are adapted for coupling to a lamp load that includes at least one discharge lamp 30.

Sensing transformer 120 is coupled to first and second hot input connections 102,104. EMI filter 140 is coupled (via terminals 142,144) to sensing transformer 120 and to neutral input connection 106. Full-wave rectifier 160 is coupled (via terminals 162,164) to EMI filter 140. PFC and inverter circuits 300 are coupled (via terminals 302,304) to full-wave rectifier 160 and capacitor C1. Finally, PFC and inverter circuits 300 are coupled (via output connections 108,110) to lamp 30.

Detector circuit 200 is coupled to sensing transformer 120. During operation, detector circuit 200 provides an output voltage, $V_{OUT}$, having a magnitude that is dependent on the states of switches S1,S2. More specifically, when both switches S1 and S2 are in the on state, the magnitude of $V_{OUT}$ is at a first level (e.g., 0 volts), causing the ballast (via PFC and inverter circuits 300) to operate lamp 30 at a first light level (e.g., 100% of full light output). When only one of the switches S1 and S2 is in the on state, the magnitude of $V_{OUT}$ is at a second level (e.g., 15 volts), causing the ballast to operate lamp 30 at a second light level (e.g., 50% of full light output).

PFC and inverter circuits 300 may be realized by any of a number of arrangements that are well known to those skilled in the art, and thus will not be described in any further detail herein. For example, PFC and inverter circuit 300 may be implemented using a boost converter followed by a driven series resonant half-bridge inverter. For purposes of the present invention, it is required that PFC and inverter circuits 300 are capable of responding to the output, $V_{OUT}$, of detector circuit 200 in the manner previously described. More specifically, it is important that PFC and inverter circuits 300 drive lamp 30 at the first light level (e.g., 100% of full light output) when $V_{OUT}$ is at the first level (e.g., zero volts), and at the second light level (e.g., 50% of full light output) when $V_{OUT}$ is at the second level (e.g., 15 volts).

Preferred structures for sensing transformer 120, EMI filter 140, full-wave rectifier 160, and detector circuit 200 are now described with reference to FIG. 3 as follows.

Sensing transformer 120 includes first and second primary windings 122,128 and a secondary winding 134. First primary winding 122 is electrically coupled to first hot input connection 102, and has a first polarity (as indicated by the dot on the left side of winding 122). Also, as described in FIG. 3, first primary winding 122 is electrically coupled (on one end) to second primary winding 128. Second primary winding 128 is electrically coupled to second hot input connection 104 and is magnetically coupled to first primary winding 122; second primary winding 128 has a second polarity (as indicated by the dot on the right side of winding 128) that is opposite that of the first polarity. Also, as described in FIG. 3, second primary winding 128 is electrically coupled (on one end) to first primary winding 122. Secondary winding 134 is magnetically coupled to first and second primary windings 122,128, and is electrically coupled to detector circuit 200.

Preferably, sensing transformer 120 is realized using a toroidal core. In order to ensure proper operation, it is important that the core have a high permeability. A high permeability is required because of the low frequency (e.g., 60 hertz) currents that flow through one or both primary windings 122,128 during operation of ballast 100. Preferably, each of the primary windings 122,128 is wound with 1 wire turn, and secondary winding 134 is wound with about 500 wire turns.

EMI filter 140 may be realized by any of a number of suitable arrangements that are well known to those skilled in the art. As an example of a preferred implementation, as described in FIG. 3, EMI filter 140 includes first and second inputs 142,144, a first inductor 146, a second inductor 152, and a capacitor 158. First and second inductors 146,152 are magnetically coupled to each other.

Full-wave rectifier 160 is preferably realized by a diode bridge comprising four diodes D1,D2,D3,D4 connected in a conventional manner. A capacitor C1 is coupled between full-wave rectifier 160 and PFC and inverter circuits 300. Capacitor C1 is typically realized by a relatively low valued capacitance (e.g., on the order of less than one microfarad; the preferred value is dependent on the number & type of lamps to be powered by the ballast).

Figure 3:
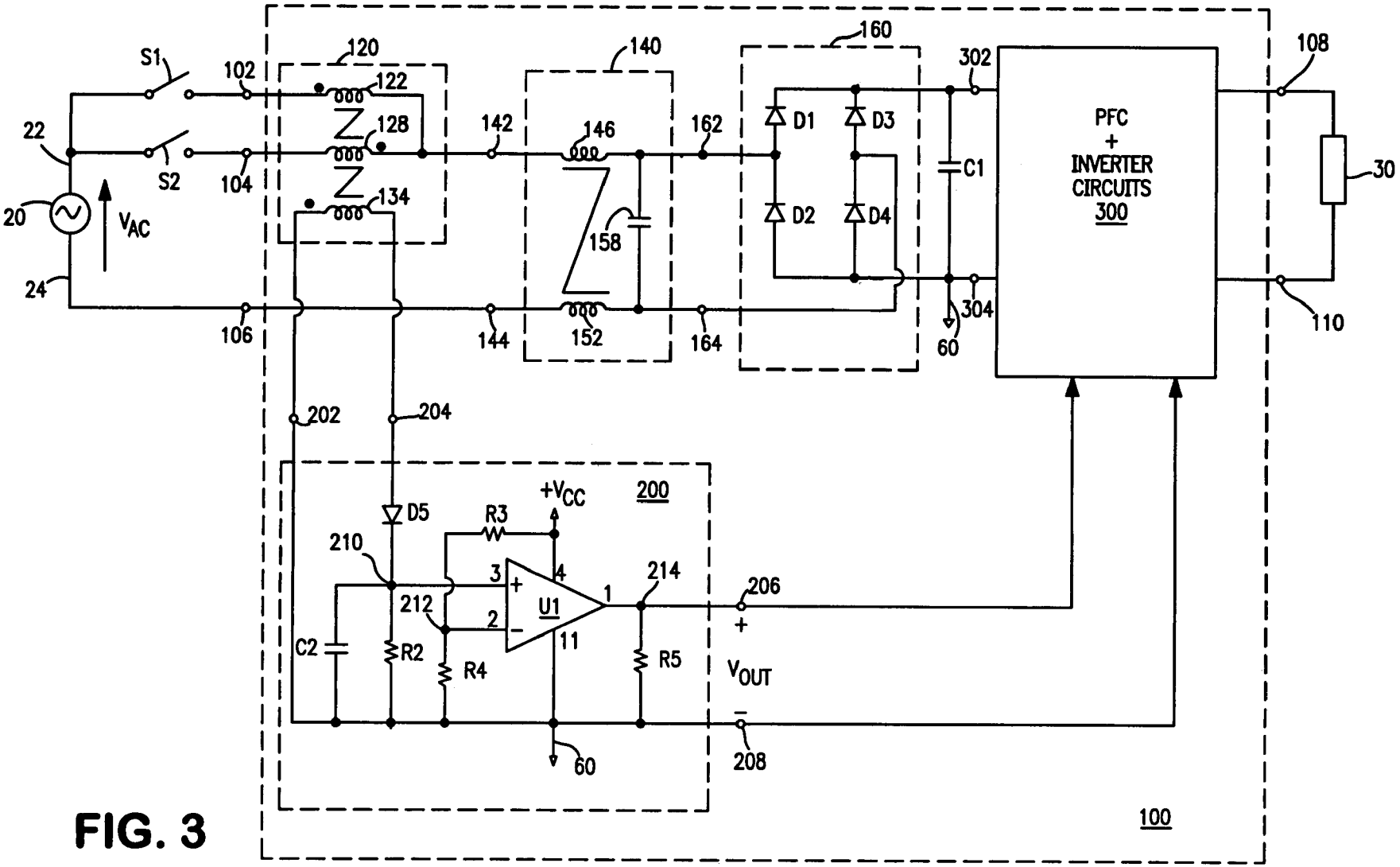
FIG. 3 is more detailed schematic diagram of a two light level ballast, in accordance with a preferred embodiment of the present invention

As described in FIG. 3, detector circuit 200 preferably includes first and second input terminals 202,204, first and second output terminals 206,208, a comparator U1, a diode D5, a first resistor R2, a capacitor C2, a second resistor R3, a third resistor R4, and a fourth resistor R5. First and second input terminals 202,204 are coupled to the secondary winding 134 of sensing transformer 120. First input terminal 202 is also coupled to a circuit ground 60. First and second output terminals 206,208 are coupled to PFC and inverter circuits 300. Second output terminal 208 is also coupled to circuit ground 60.

Comparator U1 has a non-inverting (+) input 3, an inverting (−) input 2, and a comparator output 1. Non-inverting input 3 is coupled to a first node 210, inverting input 2 is coupled to a second node 212, and comparator output 1 is coupled (via a third node 214) to first output terminal 206. Comparator U1 also includes a DC supply input 4 and a ground terminal 11. DC supply input 4 is coupled to a direct current (DC) voltage source ($+V_{CC}$) that provides a suitable DC voltage, such as +15 volts, for operating comparator U1. Ground terminal 11 is coupled to circuit ground 60.

Diode D5 is coupled between second input terminal 204 and (via first node 210) the non-inverting input 3 of comparator U1. First resistor R2 and capacitor C2 are each coupled between non-inverting input 3 and circuit ground 60. Second resistor R3 is coupled between the DC voltage source ($+V_{CC}$) and inverting input 2. Third resistor R4 is coupled between inverting input 2 and circuit ground 60. Fourth resistor R5 is coupled between comparator output 1 and circuit ground 60.

During operation of detector circuit 200, resistors R3,R4 function as a voltage divider that provides a low level reference voltage (e.g., on the order of about 100 millivolts or so) at the inverting input 2 of comparator U1. The voltage at the non-inverting input 3 is dependent on the voltage provided across input terminals 202,204 by sensing transformer 120, which, in turn, is dependent on the states of switches S1,S2. During operation, the voltage at the non-inverting input 3 is compared with the reference voltage at the inverting input 2. When the voltage at non-inverting input 3 is less than the reference voltage, the voltage at comparator output 1 (and, correspondingly, $V_{OUT}$) will be essentially zero. Conversely, when the voltage at non-inverting input 3 is greater than the reference voltage, the voltage at comparator output 1 (and, correspondingly, $V_{OUT}$) will be approximately equal to the DC supply voltage $+V_{CC}$ (e.g., 15 volts).

The detailed operation of ballast 100 and detector circuit 200 is now described with reference to FIG. 3 as follows. The four operating conditions of interest are: (i) S1 and S2 off; (b) S1 and S2 on; (c) S1 on and S2 off; and (d) S1 off and S2 on. In the following description, the frequency of AC source 20 is assumed to be 60 hertz. Additionally, unless stated otherwise, all voltages are understood to be with respect to circuit ground 60.

(a) When both switches S1 and S2 are off, no power is applied to ballast 100 and lamp 30 is not illuminated.

(b) When both switches S1 and S2 are on, $V_{OUT}$ will be at the first level (e.g., zero volts) and lamp 30 will be illuminated at a full light level. This occurs as follows. With both switches S1 and S2 turned on, substantially equal currents will flow through first and second primary windings 122,128. Because of the opposite polarities of primary windings 122,128, the flux that develops from the current flowing through first primary winding 122 will be canceled by the flux that develops from the current flowing through second primary winding 128. That is, the net flux will be approximately zero. As a result, essentially no voltage will develop across secondary winding 134. Correspondingly, the voltage at second input terminal 204 of detector circuit 200 will be essentially zero. Within detector circuit 200, the voltage at the non-inverting input 3 of comparator U1 will be essentially zero and, thus, less than the reference voltage (e.g. 0.1 volts) at the inverting input 2 of comparator U1. Consequently, the voltage at comparator output 1 (and, correspondingly, $V_{OUT}$) will be essentially zero. As previously described, with $V_{OUT}$ at zero volts, PFC and inverter circuits 300 will operate in a non-dimmed mode and power the lamp 30 at a full light level.

(c) When switch S1 is on and switch S2 is off, $V_{OUT}$ will be at the second level (e.g., 15 volts) and lamp 30 will be operated at a reduced light level. This occurs in the following manner. With S1 on and S2 off, a current will flow through first primary winding 122, but no current will flow through second primary winding 128. The flux that develops from the current flowing through first primary winding 122 will cause a low value 60 hertz AC voltage (e.g., having a peak value on the order of a few volts or so) to develop across secondary winding 134. That voltage will be applied to the second input terminal 204 of detector circuit 200. Within detector circuit 200, the voltage at the non-inverting input 3 of comparator U1 will thus be greater than the small reference voltage (e.g., 0.1 volts) at the inverting input 2 of comparator U1. Consequently, the voltage at comparator output 1 will go high (e.g., 15 volts). $V_{OUT}$ will thus be at its second level (e.g., 15 volts). As previously described, with $V_{OUT}$ at its second level, PFC and inverter circuits 300 will operate in a reduced power mode, causing lamp 30 to be illuminated at a reduced light level (e.g., 50% of full light output).

(d) When switch S1 is off and switch S2 is on, $V_{OUT}$ will be the same as previously described for when S1 is on and S2 is off (i.e., $V_{OUT}$ will be at the second level and lamp 30 will be illuminated at a reduced light level). In this case, a current will flow through second primary winding 128, but no current will flow through first primary winding 122. The flux that develops from the current flowing through second primary winding 128 will cause a low value 60 hertz AC voltage to develop across secondary winding 134. That voltage will be applied to the second input terminal 204 of detector circuit 200. Within detector circuit 200, the voltage at the non-inverting input 3 of comparator U1 will be greater than the reference voltage (e.g., 0.1 volts) that is present at the inverting input 2 of comparator U1. Consequently, the voltage at comparator output 1 will go high. $V_{OUT}$ will thus be at its second level (e.g., 15 volts). As previously described, with $V_{OUT}$ at its second level, PFC and inverter circuits 300 will operate in a reduced power mode, causing lamp 30 to be illuminated at a reduced light level (e.g., 50% of full light output).

In this way, sensing transformer 120 and detector circuit 200 monitor the states of switches S1,S2, and provide a control signal to PFC and inverter circuits 300 for selectively operating lamp 30 at two light levels.

Although the present invention has been described with reference to certain preferred embodiments, numerous modifications and variations can be made by those skilled in the art without departing from the novel spirit and scope of this invention.

What is claimed is:

1. A ballast for powering at least one gas discharge lamp from an alternating current (AC) voltage source, the ballast comprising:

a first hot input connection adapted for coupling to a hot wire of the AC voltage source via a first switch, the first switch having an on state and an off state;

a second hot input connection adapted for coupling to the hot wire of the AC voltage source via a second switch, the second switch having an on state and an off state;

a neutral input connection adapted for coupling to a neutral wire of the AC voltage source;

a sensing transformer coupled to the first and second hot input connections; and a detector circuit coupled to the sensing transformer, the detector circuit being operable to provide an output voltage having a magnitude that is dependent on the states of the first and second switches.

2. The ballast of claim 1, wherein the detector circuit is further operable such that:

(i) in response to both the first and second switches being in the on state, the magnitude of the output voltage is at a first level; and (ii) in response to only one of the first and second switches being in the on state, the magnitude of the output voltage is at a second level.

3. The ballast of claim 2, wherein the first level is approximately zero volts and the second level is approximately 15 volts.

4. The ballast of claim 1, wherein the sensing transformer comprises:

a first primary winding electrically coupled to the first hot input connection, the first primary winding have a first polarity;

a second primary winding electrically coupled to the second hot input connection, wherein the second primary winding is magnetically coupled to the first winding and has a second polarity that is opposite that of the first polarity; and a secondary winding electrically coupled to the detector circuit, wherein the secondary winding is magnetically coupled to the first and second primary windings.

5. The ballast of claim 4, wherein the detector circuit comprises:

first and second input terminals coupled to the secondary winding of the sensing transformer, wherein the first input terminal is coupled to circuit ground;

first and second output terminals, wherein the second output terminal is coupled to circuit ground; and a comparator having a non-inverting input, an inverting input, and a comparator output, wherein the non-inverting input is coupled to the second input terminal, the inverting input is coupled to a reference voltage, and the comparator output is coupled to the first output terminal.

6. The ballast of claim 5, wherein the detector circuit further comprises:

a diode coupled between the second input terminal and the non-inverting input of the comparator;

a first resistor coupled between the non-inverting input of the comparator and circuit ground;

a capacitor coupled between the non-inverting input of the comparator and circuit ground;

a second resistor coupled between a direct current (DC) voltage source and the inverting input of the comparator;

a third resistor coupled between the inverting input of the comparator and circuit ground; and a fourth resistor coupled between the comparator output and circuit ground.

7. A ballast for powering at least one gas discharge lamp from an alternating current (AC) voltage source, the ballast comprising:

a plurality of input connections, comprising:

a first hot input connection adapted for coupling to a hot wire of the AC voltage source via a first switch, the first switch having an on state and an off state;

a second hot input connection adapted for coupling to the hot wire of the AC voltage source via a second switch, the second switch having an on state and an off state; and a neutral input connection adapted for coupling to a neutral wire of the AC voltage source;

first and second output connections adapted for coupling to the at least one gas discharge lamp;

a sensing transformer coupled to the first and second hot input connections;

an electromagnetic interference (EMI) filter coupled to the sensing transformer and to the neutral input connection;

a full-wave rectifier circuit coupled to the EMI filter;

power factor correction (PFC) and inverter circuits coupled between the full-wave rectifier circuit and the first and second output connection; and a detector circuit coupled to the sensing transformer and to the PFC and inverter circuits, the detector circuit being operable to provide an output voltage having a magnitude that is dependent on the states of the first and second switches.

8. The ballast of claim 7, wherein the detector circuit is further operable such that:

(i) in response to both the first and second switches being in the on state, the magnitude of the output voltage is at a first level; and (ii) in response to only one of the first and second switches being in the on state, the magnitude of the output voltage is at a second level.

9. The ballast of claim 8, wherein the first level is approximately zero volts and the second level is approximately 15 volts.

10. The ballast of claim 7, wherein the sensing transformer comprises:

a first primary winding electrically coupled to the first hot input connection, the first primary winding have a first polarity;

a second primary winding electrically coupled to the second hot input connection, wherein the second primary winding is magnetically coupled to the first winding and has a second polarity that is opposite that of the first polarity; and a secondary winding electrically coupled to the detector circuit, wherein the secondary winding is magnetically coupled to the first and second primary windings.

11. The ballast of claim 10, wherein the detector circuit comprises:

first and second input terminals coupled to the secondary winding of the sensing transformer, wherein the first input terminal is coupled to circuit ground;

first and second output terminals coupled to the PFC and inverter circuits, wherein the second output terminal is coupled to circuit ground; and a comparator having a non-inverting input, an inverting input, and a comparator output, wherein the non-inverting input is coupled to the second input terminal, the inverting input is coupled to a reference voltage, and the comparator output is coupled to the first output terminal.

12. The ballast of claim 11, wherein the detector circuit further comprises:

a diode coupled between the second input terminal and the non-inverting input of the comparator;

a first resistor coupled between the non-inverting input of the comparator and circuit ground;

a capacitor coupled between the non-inverting input of the comparator and circuit ground;

a second resistor coupled between a direct current (DC) voltage source and the inverting input of the comparator;

a third resistor coupled between the inverting input of the comparator and circuit ground; and a fourth resistor coupled between the comparator output and circuit ground.

13. A ballast for powering at least one gas discharge lamp from an alternating current (AC) voltage source, the ballast comprising:

a plurality of input connections, comprising:

a first hot input connection adapted for coupling to a hot wire of the AC voltage source via a first switch, the first switch having an on state and an off state;

a second hot input connection adapted for coupling to the hot wire of the AC voltage source via a second switch, the second switch having an on state and an off state; and a neutral input connection adapted for coupling to a neutral wire of the AC voltage source;

first and second output connections adapted for coupling to the at least one gas discharge lamp;

a sensing transformer, comprising:

a first primary winding electrically coupled to the first hot input connection, the first primary winding have a first polarity;

a second primary winding electrically coupled to the second hot input connection, wherein the second primary winding is magnetically coupled to the first winding and has a second polarity that is opposite that of the first polarity; and a secondary winding electrically coupled to the detector circuit, wherein the secondary winding is magnetically coupled to the first and second primary windings;

an electromagnetic interference (EMI) filter coupled to the sensing transformer and to the neutral input connection;

a full-wave rectifier circuit coupled to the EMI filter;

power factor correction (PFC) and inverter circuits coupled to the full-wave rectifier circuit; and a detector circuit coupled to the sensing transformer and to the PFC and inverter circuits, the detector circuit comprising:

first and second input terminals coupled to the secondary winding of the sensing transformer, wherein the first input terminal is coupled to circuit ground;

first and second output terminals coupled to the PFC and inverter circuits, wherein the second output terminal is coupled to circuit ground;

a comparator having a non-inverting input, an inverting input, and a comparator output, wherein the comparator output is coupled to the first output terminal;

a diode coupled between the second input terminal and the non-inverting input of the comparator;

a first resistor coupled between the non-inverting input of the comparator and circuit ground;

a capacitor coupled between the non-inverting input of the comparator and circuit ground;

a second resistor coupled between a direct current (DC) voltage source and the inverting input of the comparator;

a third resistor coupled between the inverting input of the comparator and circuit ground; and a fourth resistor coupled between the comparator output and circuit ground.

14. The ballast of claim 13, wherein the detector circuit is operable such that:

(i) in response to both the first and second switches being in the on state, the magnitude of the output voltage is at a first level; and (ii) in response to only one of the first and second switches being in the on state, the magnitude of the output voltage is at a second level.

15. The ballast of claim 14, wherein the first level is approximately zero volts and the second level is approximately 15 volts.

* * * * *